United States Patent [19]

Van den Abbeel

[11] Patent Number: 4,779,510

[45] Date of Patent: Oct. 25, 1988

[54] ELECTRONIC APPARATUS FOR DISPLAYING MUSIC

[76] Inventor: Paul Van den Abbeel, 129 Nieuwe Baan, 9180 Belsele, Belgium

[21] Appl. No.: 123,358

[22] Filed: Nov. 20, 1987

[51] Int. Cl.[4] ..... A63J 17/00

[52] U.S. Cl. ..... 84/464 R; 355/15; 355/122; 84/470 R

[58] Field of Search ..... 84/453, 464 R, 470 R, 84/477 R, 486, 487; 353/15, 122; 40/341, 342, 343; 248/441.1, 444.1

[56] References Cited

U.S. PATENT DOCUMENTS

| | | | |
|---|---|---|---|
| 1,170,325 | 2/1916 | Poposkey | 84/470 |
| 1,837,944 | 12/1931 | Blum | 84/470 |
| 1,965,906 | 7/1934 | Pettingell | 84/470 |
| 2,512,828 | 6/1950 | Collins | 353/15 |
| 3,064,518 | 11/1962 | Chernishenko | 84/487 |
| 3,490,328 | 1/1970 | King | 84/464 |
| 3,577,824 | 5/1971 | Lavan | 84/470 X |
| 3,601,904 | 8/1971 | Elliott, Jr. et al. | 84/470 X |
| 3,724,097 | 4/1973 | Schmoyer | 84/470 X |
| 3,756,716 | 9/1973 | Gitchel | 353/122 X |
| 4,097,135 | 6/1978 | Castor | 84/470 R X |

FOREIGN PATENT DOCUMENTS

| | | | |
|---|---|---|---|
| 901563 | 5/1985 | Belgium . | |
| 2537356 | 3/1977 | Fed. Rep. of Germany | 84/464 |
| 2707613 | 8/1978 | Fed. Rep. of Germany | 84/470 R |
| 3342190 | 5/1985 | Fed. Rep. of Germany . | |
| 2494472 | 5/1982 | France . | |
| 2154782 | 9/1985 | United Kingdom | 84/470 R |
| WO84/04613 | 11/1984 | PCT Int'l Appl. . | |

*Primary Examiner*—W. B. Perkey
*Attorney, Agent, or Firm*—Young & Thompson

[57] ABSTRACT

An apparatus comprising a console having a screen for displaying a music score recorded on a score support. In addition to information representing the music score, the score support has position indicators at predetermined locations along the support, each position indicator corresponding to a reference signature in the score. The console includes means for reading and displaying the score information carried by the support, driving means responsive to a control signal to move forward the score support thereby to display successive portions of the score on the screen, electronic control means adapted to monitor the performance of a piece of music, recognize therein the predetermined reference signature and produce a page change command signal for moving forward the score support each time a reference signature is recognized in the musical performance such that successive portions of the score are displayed on the screen, and a keyboard for use by an operator.

5 Claims, 2 Drawing Sheets

ELECTRONIC APPARATUS FOR DISPLAYING MUSIC

BACKGROUND OF THE INVENTION

This invention relates to an electronic apparatus with stored control for displaying a music score on a screen.

Musicians often have to manage with slovenly scores or even scores that are in bad condition, for the music scores are expensive and not regularly republished. Further, at the end of each page, most instrumentalists are obliged to interrupt their performance in order to turn over a page.

SUMMARY OF THE INVENTION

The object of the invention is an electronically controlled apparatus providing each musician of an orchestra with an impeccable and clear score, thus avoiding any unhandy manipulations. In accordance with this invention, an apparatus is provided comprising:

a screen for displaying a music score;

means for receiving and positioning a score support, said score support having information representing a score to be performed and position indicators at predetermined spaced locations along the score support, each of said position indicators corresponding to preselected bars forming reference staves in the score, said position indicators defining the forward steps of the score support;

means for reading and displaying the score information carried by said support;

driving means responsive to a control signal to move forward the score support thereby to display successive portions of the score on the screen;

electronic control means adapted to monitor the performance of a piece of music, recognize therein said predetermined reference staves and produce a page change command signal for moving forward said score support each time a reference stave is recognized in the musical performance such that successive portions of the score are displayed on the screen; and a keyboard for use by an operator.

In an exemplary embodiment, the electronic control means comprise:

a microphone to pick up the sounds emitted during the performance of a piece of music and produce electrical signals representing the successive music sounds;

an analog/digital converter to translate the analog signals from the microphone into binary signal codes;

memory means containing reference binary signals representing predetermined reference staves in the music score;

stave recognition means connected to receive the binary signals from the converter and the reference signals read out from the memory, said stave recognition means being adapted to produce a page change command signal each time a typical sequence of binary signals from the converter is identical to a reference signal, said page change command signal serving to activate the score support driving means for moving forward the score support thereby to display a next portion of the score on the screen.

According to this invention the device allows each performer of a musical ensemble to have at his disposal clear and impeccable scores, and allows the score to run synchronously for everyone. Unhandy manipulations are thereby being avoided, and the conductor is able to intervene more effectively, precisely and rapidly.

DESCRIPTION OF AN EXEMPLARY EMBODIMENT OF THE INVENTION

Figure 1:
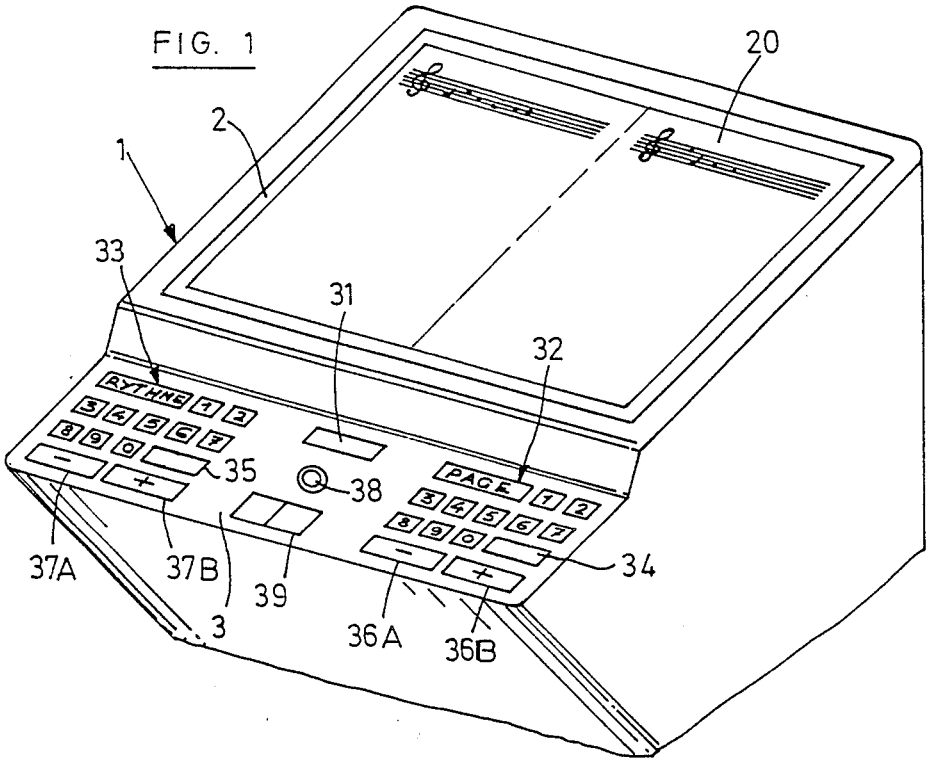
FIG. 1 is a perspective view of an exemplary console for the apparatus according to the invention.

Referring to FIG. 1 there is shown an exemplary apparatus according to the invention. The apparatus consists of a console 1 having a display screen 2 intended for displaying a portion of a music score 20 and a control keyboard 3 to be actuated by the user as will be explained later herein. In the exemplary embodiment shown, the screen 2 is arranged for the simultaneous display of two successive pages of a score. The score is recorded on a support of any type: a microfilm housed in a cassette or beared by a visual disc, a floppy, a magnetic disc, a video disc for instance. The score support is operatively connected to a device for reading the score and displaying it on the screen 2. The read and display device is obviously adapted to the type of the score support.

Figure 2:
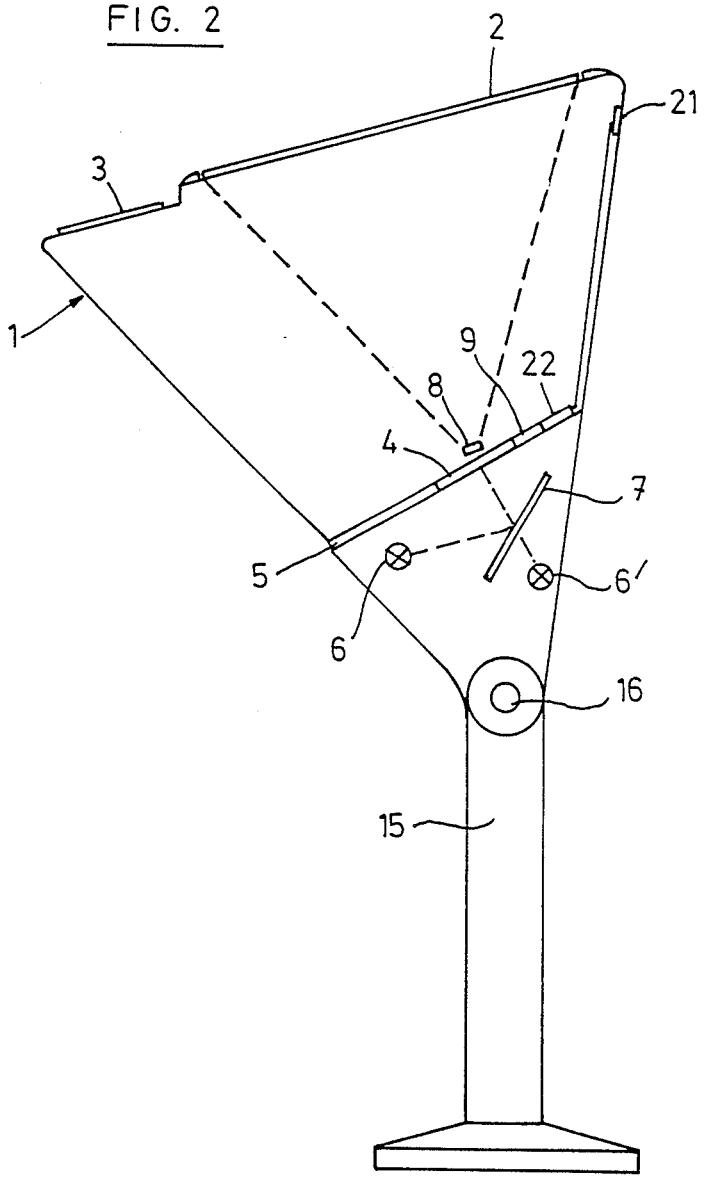
FIG. 2 depicts schematically an exemplary embodiment of the apparatus according to the invention.

FIG. 2 depicts diagrammatically a simple exemplary embodiment. The console 1 is mounted on a base 15 so as to be tiltable conformably to the user's option by swivelling about a pivot 16. It is to be understood that the console can also be mounted in any other way, including a fixed mode.

In the exemplary embodiment shown, the score support 4 is a microfilm housed in a compartment 5 in the console 1, e.g. a drawer, in order to operatively cooperate with an optical system arranged for allowing a portion of the score recorded on the support 4 to be displayed on the screen 2. The optical system comprises a light source 6, a mirror 7, e.g. a semi-transparent mirror, and an object lens 8. An auxiliary light source 6' is also provided as stand-by. When the score support 4 is correctly positioned, the picture thereon is illuminated by the light beam coming from the light source after reflection by the mirror 7, and the visual information in the picture is being project onto the screen 2 through the object lens 8.

A driving device 9 is provided to move forward the score support 4 in response to a page change command signal so as to allow the page which is being displayed on the screen 2 to be replaced by the next page at the required time. The page change command signal is produced by a built-in electronic control device which will be described later herein. The score support is moved forward page by page, the moving pace being controlled by position indicators provided on the score support.

On every page of the score there is chosen a typical set of music staves for serving as reference staves on that page with a view to command and control the moving forward of the score support such that the next portion or next page of the score is displayed on the screen. Each reference stave is represented and identified by a sequence of reference binary signals RC stored in a memory. In an exemplary embodiment, the reference signals RC are stored at locations provided on the score support itself and arranged along the recorded score. In another embodiment, the reference signals RC can be stored in a separate memory, the moving forward of which is related to the moving forward of the score support. The reference signals RC are used in the electronic control device which is described hereinafter with reference to FIG. 3.

As a piece of music is being performed, a microphone 21 mounted on the console 1 receives the musical sounds and produces electric signals FS corresponding to the successive musical sounds. These signals FS are converted into binary signal codes BC in an analog/-digital converter 23, an apparatus known per se. Each binary code BC is applied to line 100 and received in a stave recognition device 24 which consists in a logic arrangement adapted to compare the binary signals from the converter with the stored reference signals RC and to produce a page change command signal each time a sequence of binary signals BC resulting from the performance of the piece of music is identical to a reference sequence RC. The reference signals RC are read selectively from the memory 26 by a reader or scrutator 25 (the memory 26 represents said memory track on the score support or a separate memory area). The reader or scrutator is comprises of any device known per se, adapted for reading binary signals.

Figure 3:
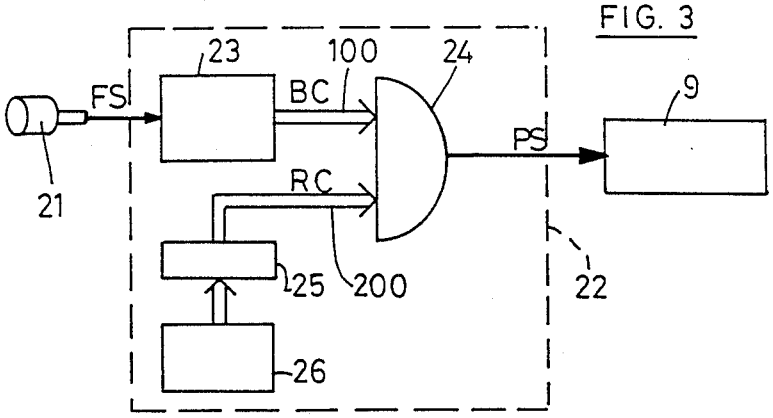
FIG. 3 is a schematic diagram of an exemplary embodiment of the electronic control system provided in the console.

In FIG. 3 the stave recognition device is represented symbolically by the conventional graphic representation of an AND-gate which performs the general logic function of the device. However, it will be obvious to one skilled in the art that the device 24 can be implemented in the form of various circuit arrangements using logic elements known per se, adapted to be capable of performing the logic function as described herein, such circuit arrangements including a number of elements that, it is known, is related to the number of bits used to represent a musical sound and to the number of staves forming a reference sequence. The implementation of a circuit arrangement serving the purpose is within the ordinary skill of a man of the art.

The recognition device 24 accepts at a first input the binary signals BC from the converter through line 100. At a second inupt thereof, the recognition device 24 accepts the reference sequence RC supplied by the reader 25 through line 200. A reference sequence RC is read from the memory 26 at every position of the score support 4. When a sequence of binary signals BC is identical to a reference sequence RC, that is when a typical set of music staves chosen as a characteristic signature on a page is recognized, the stave recognition device 24 outputs a page change command signal PS for actuating the driving means 9 in order to move forward the score support 4 such that the next portion or next page of the score is displayed on the screen. The reader 25 then reads the reference sequence RC for the next page and inputs the reference sequence to the stave recognition device 24; when a sequence of binary signals BC is received, which is identical to the said reference sequence RC, the stave recognition device 24 outputs a page change command signal PS again. Thus, as the performance proceeds, the score displayed on the screen is automatically shifted page by page.

In case the memory 26 is not provided on the score support, the page change commmand signal PS can be arranged for simultaneously actuating the driver 9 and moving forward the memory 26 so as to allow the reader 25 to read the next reference sequence RC, that is the reference sequence corresponding to the set of reference staves chosen on the next page of the music score.

The page change command signal can be produced with some predetermined delay in accordance with the number of music staves remaining to be performed between the set of reference staves chosen as a reference on a page and the last music stave appearing on that page. Each time a reference stave is being recognized during the performance of a piece of music, the score displayed on the screen is shifted page by page. When the screen 2 is arranged for the simultaneous display of two consecutive pages of the music score as shown in FIG. 2 for instance, the screen displays successively the pages 1–2, then pages 2–3, thereafter pages 3–4 and so on as the performance proceeds.

Thanks to the invention, each performer of a musical ensemble can always dispose of a clear and impeccable score, and will thus be spared unhandy manipulations during a performance. In addition, the score is synchronously respresented for each performer, resulting in a better harmony of the ensemble.

The automatic step-by-step moving forward of the score support under control of the electronic control system can be stopped by the user by means of the keyboard 3.

A general view of an exemplary embodiment is shown in FIG. 1 in which the connections between the keyboard and the control system 22 are not being represented in order not to overload the drawing. The keyboard is, amongst other things, designed to allow the user to choose at random any page of the score or to change pages after having put the system into manual operation mode, that is after having switched off the automatic control system. In the example shown in FIG. 1, one notices a change-over switch 31 for disabling the electronic system and enter the orders manually. The number of the page to be displayed on the screen is being chosen by actuating the corresponding key(s) on keyboard 32, the page number being immediately displayed on an indicator 34, e.g. an LCD. Two keys 36A and 36B cause a sheet to go to and from respectively. This of course can be useful during rehearsals.

The keyboard shown in FIG. 1 also allows the user, after having put the system into manual mode, to adapt the rhythm of a musical movement. By actuating keys on the keyboard 33 the user forms a number indicating the number of times per minute in which to play the said movement. This number is displayed on an indicator 35, e.g. an LCD. The keys 37A and 37B permit the rhythm to be reduced or increased by one period at a time. The thus chosen rhythm can be indicated by a flashing warning light 38, which for instance can be energized by a time signal generator, the frequency of which is determined by the combination of signals produced by the keys that have been actuated by the user on the keyboard 33. By actuating again the change-over switch 31 the use can put the system again into automatic operation mode, so that the electronic control system is operative again. In that way, rehearsals are made easier by enabling the conductor to intervene more accurately and more effectively. Of course, a change-over switch 39 is also provided to switch on/off the system. When this change-over switch is off, the control system is arranged to automatically bring back the score support to its initial position, so that everything is ready for a new performance. After that the apparatus is switched off.

It is to be understood that the arrangement of the means for reading and displaying the score may be different from the one illustrated, and that it will be adapted properly to the type of score support. This support, it has been said earlier herein, is not restricted to be a microfilm or a visual disc, but it may be comprised of a magnetic disc or a video-disc for instance. In this case, the read and display device will comprise the proper reading means for reading the information recorded on the score support, and means for converting the information read from the said support into signals adapted to represent the music score on the display unit.

What is claimed is:

1. An electronic apparatus for displaying a music score, said apparatus comprising a console including:

a screen for displaying a music score;

means for receiving and positioning a score support, said score support having information representing a score to be performed and position indicators at predetermined spaced locations along the score support, each of said position indicators corresponding to preselected bars forming reference staves in the score, said position indicators defining the forward steps of the score support;

means for reading and displaying the score information carried by said support;

driving means responsive to a control signal to move forward the score support thereby to display successive portions of the score on the screen;

electronic control means adapted to monitor the performance of a piece of music, recognize therein said predetermined reference staves and produce a page change command signal for moving forward said score support each time a reference stave is recognized in the musical performance such that successive portions of the score are displayed on the screen; and a keyboard for use by an operator.

2. The apparatus according to the claim 1 wherein the electronic control means comprise:

a microphone to pick up the sounds emitted during the performance of a piece of music and produce electrical signals representing the successive music sounds;

an analog/digital converter to translate the analog signals from the microphone into binary signal codes;

memory means containing reference binary signals representing predetermined reference staves in the music score;

stave recognition means connected to receive the binary signals from the converter and the reference signals read out from the memory, said stave recognition means being adapted to produce a page change command signal each time a typical sequence of binary signals from the converter is identical to a reference signal, said page change command signal serving to activate the score support driving means for moving forward the score support thereby to display a next portion of the score on the screen.

3. The apparatus according to claim 2, characterized by said memory means being arranged on the score support.

4. The apparatus according to claim 1, wherein the score support carries score information in the form of visual pictures, and wherein said means for reading and displaying the score information comprise optical means arranged to project the visual information from the score support on the screen.

5. The apparatus according to claim 1, wherein the score support carries score information in the form of stored information, and wherein said means for reading and displaying the score information comprise reading means for reading the information stored on the score support and translating means to translate the information read out from the memory means into signals adapted for displaying the score on the display screen.

* * * * *